US010513950B2

(12) United States Patent
Adachi et al.

(10) Patent No.: US 10,513,950 B2
(45) Date of Patent: Dec. 24, 2019

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Noriyasu Adachi, Namazu (JP); Keisuke Sasaki, Susono (JP); Shigehiro Sugihira, Susono (JP); Takayoshi Kawai, Susono (JP); Shinji Sadakane, Susono (JP); Hiroyuki Sugihara, Shizuoka-ken (JP); Kaoru Ohtsuka, Mishima (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/914,580

(22) Filed: Mar. 7, 2018

(65) Prior Publication Data

US 2018/0306069 A1 Oct. 25, 2018

(30) Foreign Application Priority Data

Apr. 24, 2017 (JP) ..... 2017-085309

(51) Int. Cl.
*F01L 1/047* (2006.01)
*F01L 13/00* (2006.01)
*F01L 1/053* (2006.01)

(52) U.S. Cl.
CPC ..... *F01L 1/047* (2013.01); *F01L 13/0036* (2013.01); *F01L 1/053* (2013.01); (Continued)

(58) Field of Classification Search
CPC ..... F01L 1/047; F01L 1/053; F01L 13/0036; F01L 2013/0052; F01L 2013/101; F01L 2013/116; F01L 2800/05; F01L 2820/02
(Continued)

(56) References Cited

U.S. PATENT DOCUMENTS

2011/0296818 A1 12/2011 Hashimoto et al.
2012/0138002 A1* 6/2012 Tsuzuki ..... F01L 1/185 123/90.18

(Continued)

FOREIGN PATENT DOCUMENTS

DE 102004027966 A1 1/2006
JP S63189651 A 8/1988

(Continued)

*Primary Examiner* — Mark A Laurenzi
*Assistant Examiner* — Kelsey L Stanek
(74) *Attorney, Agent, or Firm* — Hunton Andrews Kurth LLP

(57) ABSTRACT

Provided is a control device for an internal combustion engine equipped with a cam switching device including a cam groove provided on the outer peripheral surface of a camshaft and an electromagnetic solenoid type actuator capable of protruding, toward the camshaft, an engagement pin that is engageable with the cam groove. The control device is configured, in causing the cam switching device to perform a cam switching operation, to perform energization of the actuator such that the engagement pin is seated on a forward outer peripheral surface, and to more lower, when an electric current (coil current) flowing through the actuator as a result of the energization is greater, an average electric voltage per unit time applied to the actuator in protruding the engagement pin toward the cam groove from the forward outer peripheral surface.

3 Claims, 10 Drawing Sheets

(52) U.S. Cl.
CPC . *F01L 2013/0052* (2013.01); *F01L 2013/101* (2013.01); *F01L 2013/116* (2013.01); *F01L 2800/05* (2013.01); *F01L 2820/02* (2013.01)

(58) Field of Classification Search
USPC ..... 123/90.16, 90.15, 90.11
See application file for complete search history.

(56) References Cited

U.S. PATENT DOCUMENTS

| | | | | |
|---|---|---|---|---|
| 2012/0222635 | A1 | 9/2012 | Sunada et al. | |
| 2015/0194250 | A1 | 7/2015 | Vopel | |
| 2015/0377095 | A1* | 12/2015 | Walther ..... | F01L 13/0036 73/114.79 |

FOREIGN PATENT DOCUMENTS

| | | | |
|---|---|---|---|
| JP | 2007016648 | A | 1/2007 |
| JP | 2011252470 | A | 12/2011 |
| WO | 2011-064852 | A1 | 6/2011 |

* cited by examiner

Deep-groove seating mode

Outer-periphery seating mode

Two-time energization mode

CONTROL DEVICE FOR INTERNAL COMBUSTION ENGINE

CROSS-REFERENCE TO RELATED APPLICATION

This application is based on and claims the benefit of Japanese Patent Application No. 2017-085309, filed on Apr. 24, 2017, which is incorporated by reference herein in its entirety.

BACKGROUND

Technical Field

The present disclosure relates to a control device for an internal combustion engine, and more particularly to a control device for controlling an internal combustion engine that includes a cam switching device that is capable of switching a cam that drives an intake valve or an exhaust valve that opens and closes a combustion chamber.

Background Art

For example, DE 102004027966 A1 discloses an internal combustion engine system that includes a cam switching device that is capable of selectively switching between a plurality of cams for driving a valve that opens and closes a combustion chamber. This cam switching device is provided with a cam groove (i.e., a spiral groove), an actuator and a cam carrier. The carrier is attached to a camshaft in such a manner as to be slidable in the axial direction of the camshaft. The cam groove is formed on an outer peripheral surface of this cam carrier. Moreover, the plurality of cams described above are fixed to the cam carrier. The actuator has an engagement pin that is capable of engaging with the cam groove, and is configured in such a way as to be capable of protruding the engagement pin toward the cam groove. Furthermore, the cam switching device is configured such that, while the engagement pin is inserted into the cam groove by the operation of the actuator, the cam carrier slides in the axial direction of the camshaft in association with the rotation of the camshaft. With the cam carrier sliding in this way, the cam that drives the valve is switched.

The actuator described above is of an electromagnetic solenoid type. The operating timing of the actuator (more specifically, the timing at which the operation to protrude the engagement pin toward the cam groove) is adjusted in accordance with various operating conditions of the actuator (more specifically, at least in accordance with one or both of the temperature and the operating voltage of the actuator).

DE 102004027966 A1 is a patent document which may be related to the present disclosure.

SUMMARY

In a cam switching device that includes an electromagnetic solenoid actuator for causing an engagement pin to be inserted into a cam groove, as with the cam switching device disclosed in DE 102004027966 A1, even if the electric voltage applied to a coil of the actuator is constant, the electric current (the coil current) that flows through the coil to drive the engagement pin becomes different depending on various electric current change factors, such as a change of the temperature of the coil of the actuator. In more detail, if, for example, the coil temperature becomes lower, the resistance value thereof decreases, and the value of the coil current at the same electric voltage thus becomes greater. Because of this, there is a concern that, if the coil temperature becomes greatly lower, the coil current may become excessively greater and that, as a result, parts (for example, an electronic control unit (ECU)) around the actuator may be overheated.

The present disclosure has been made to address the problem described above, and an object of the present disclosure is to provide a control device for an internal combustion engine that includes a cam switching device having a cam groove provided on an outer periphery surface of a camshaft and an electromagnetic solenoid type actuator capable of protruding toward the camshaft an engagement pin engageable with the cam groove, and that can perform a cam switching operation while preventing the coil current of the actuator from excessively increasing due to various electric current change factors, such as a change of the coil temperature.

A control device for an internal combustion engine according to the present disclosure is configured to control an internal combustion engine that includes:

a camshaft which is driven to rotate;

a plurality of cams which are provided at the camshaft and whose profiles are different from each other; and a cam switching device configured to perform a cam switching operation that switches, between the plurality of cams, a cam that drives a valve that opens and closes a combustion chamber.

The cam switching device includes:

a cam groove which is provided on an outer peripheral surface of the camshaft; and an electromagnetic solenoid actuator which is equipped with an engagement pin engageable with the cam groove, and which is capable of protruding the engagement pin toward the camshaft.

The cam switching device is configured such that, while the engagement pin is engaged with the cam groove, the cam that drives the valve is switched between the plurality of cams in association with a rotation of the camshaft.

The outer peripheral surface of the camshaft includes a forward outer peripheral surface which is located more forward than an end of the cam groove on a forward side in a rotational direction of the camshaft.

The control device is configured, in causing the cam switching device to perform the cam switching operation, to perform energization of the actuator such that the engagement pin is seated on the forward outer peripheral surface, and to more lower, when an electric current flowing through the actuator as a result of the energization is greater, an average electric voltage per unit time applied to the actuator in protruding the engagement pin toward the cam groove from the forward outer peripheral surface.

The control device may be configured, if a time required from a start of a protruding operation of the engagement pin toward an inside of the cam groove until a completion thereof is longer than a certain time in causing the cam switching device to perform the cam switching operation with the energization for seating the engagement pin on the forward outer peripheral surface, to retract the engagement pin from the forward outer peripheral surface after the engagement pin is seated on the forward outer peripheral surface, and to perform energization of the actuator such that the engagement pin is protruded in the cam groove during a combustion cycle that is the same as a combustion cycle in which the engagement pin has been seated on the forward outer peripheral surface.

The certain time may be shorter when an engine speed is higher.

According to the control device for an internal combustion engine of the present disclosure, in causing the cam switching device to perform the cam switching operation, energization of the actuator is performed such that the engagement pin is seated on the forward outer peripheral surface and such that an average electric voltage per unit time applied to the actuator in protruding thereafter the engagement pin toward the cam groove from the forward outer peripheral surface is lowered more when an electric current flowing through the actuator as a result of this energization is greater. The electric current that flows through the electromagnetic solenoid actuator in response to the energization changes depending on various electric current change factors, such as a change of the temperature of a coil of the actuator. For example, this electric current becomes greater when the coil temperature of the actuator is lower. Thus, by more lowering the average electric voltage when the electric current is greater, the control device can perform a cam switching operation while preventing the coil current of the actuator from excessively increasing due to various electric current change factors, such as a change of the coil temperature.

DETAILED DESCRIPTION

In the following, embodiments of the present disclosure are described with reference to FIGS. 1 to 14. However, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Furthermore, structures or steps or the like that are described in conjunction with the following embodiments are not necessarily essential to the present disclosure unless explicitly shown otherwise, or unless the present disclosure is explicitly specified by the structures, steps or the like theoretically.

1. Configuration of System According to First Embodiment

An internal combustion engine 1 which a system according to the present embodiment includes is mounted in a vehicle, and is used as a power source thereof. The internal combustion engine 1 according to the present embodiment is a four-stroke in-line four-cylinder engine, as an example. The firing order of the internal combustion engine 1 is a first cylinder #1 to a third cylinder #3, to a fourth cylinder #4 and to a second cylinder #2, as an example.

Figure 1:
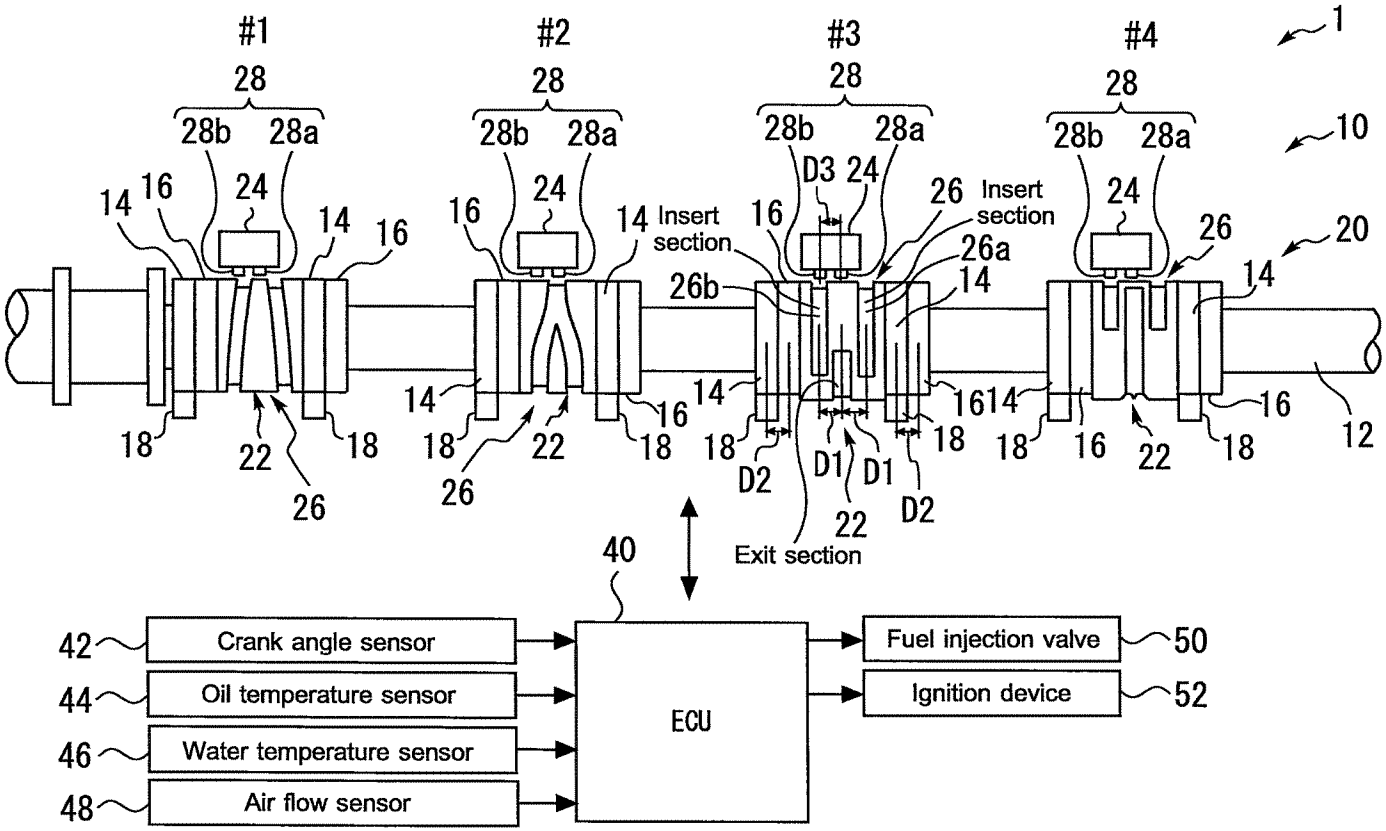
FIG. 1 is a diagram that schematically illustrates a configuration of a main part of a valve train of an internal combustion engine according to a first embodiment of the present disclosure.

FIG. 1 is a diagram that schematically illustrates a configuration of a main part of a valve train of the internal combustion engine 1 according to the first embodiment of the present disclosure. In the internal combustion engine 1, two intake valves (not shown in the drawings) are provided for each cylinder, as an example. Moreover, the internal combustion engine 1 is provided with a variable valve operating device 10 for driving these two intake valves. It should be noted that the variable valve operating device 10 described below is applicable to a valve that opens and closes a combustion chamber, and thus, it may be used to drive an exhaust valve, instead of the intake valve.

1-1. Camshaft

The variable valve operating device 10 is equipped with a camshaft 12 for driving the intake valves for each cylinder. The camshaft 12 is connected to a crankshaft (not shown in the drawings) via a timing pulley and a timing chain (or a timing belt) which are not illustrated, and is driven to rotate at half of the speed of the crankshaft by the torque of the crankshaft.

1-2. Intake Cam

The variable valve operating device 10 is equipped with a plurality of (as an example, two) intake cams 14 and 16 whose profiles are different from each other and which are provided for the individual intake valves in each cylinder. The intake cams 14 and 16 are attached to the camshaft 12 in a manner described later. The profile of the intake cam 14 is set such that the intake cam 14 serves as a "small cam" for obtaining, as the lift amount and the operating angle (i.e., the crank angle width in which the intake valve is open) of the intake valve, a lift amount and an operating angle that are relatively smaller. The profile of the remaining intake cam 16 is set such that the intake cam 16 serves as a "large cam" for obtaining a lift amount and an operating angle that are greater than the lift amount and the operating angle obtained by the intake cam 14. It should be noted that one of the profiles of the plurality of intake cams may have only a base circle section in which the distance from the axis of the camshaft 12 is constant. That is, one of the intake cams may alternatively be set as a zero lift cam which does not give a pressing force to the intake valve.

A rocker arm 18 for transmitting a pressing force from the intake cam 14 or 16 to the intake valve is provided for each of the intake valves. FIG. 1 shows an operating state in which the intake valves are driven by the intake cams (small cams) 14. Thus, in this operating state, each of the intake cams 14 is in contact with the corresponding rocker arm 18 (more specifically, a roller of the rocker arm 18).

1-3. Cam Switching Device

The variable valve operating device 10 is further equipped with a cam switching device 20. The cam switching device 20 performs a cam switching operation by which the cam that drives the intake valve (in other words, the cam that is to be mechanically connected to the intake valve) is switched between the intake cams 14 and 16. The cam switching device 20 is equipped with a cam carrier 22 and an actuator 24 for each cylinder.

The cam carrier 22 is supported by the camshaft 12 in a form that the cam carrier 22 is slidable in the axial direction of the camshaft 12 and that the movement of the cam carrier 22 in the rotational direction of the camshaft 12 is restricted. As shown in FIG. 1, two pairs of intake cams 14 and 16 for driving two intake valves in the same cylinder are formed on the cam carrier 22. Also, the intake cams 14 and 16 of each pair are disposed adjacently to each other. Moreover, a cam groove 26 is formed on the outer peripheral surface of each cam carrier 22 that corresponds to a part of the outer peripheral surface of the camshaft 12.

(Cam Groove)

Figures 2A, 2B:
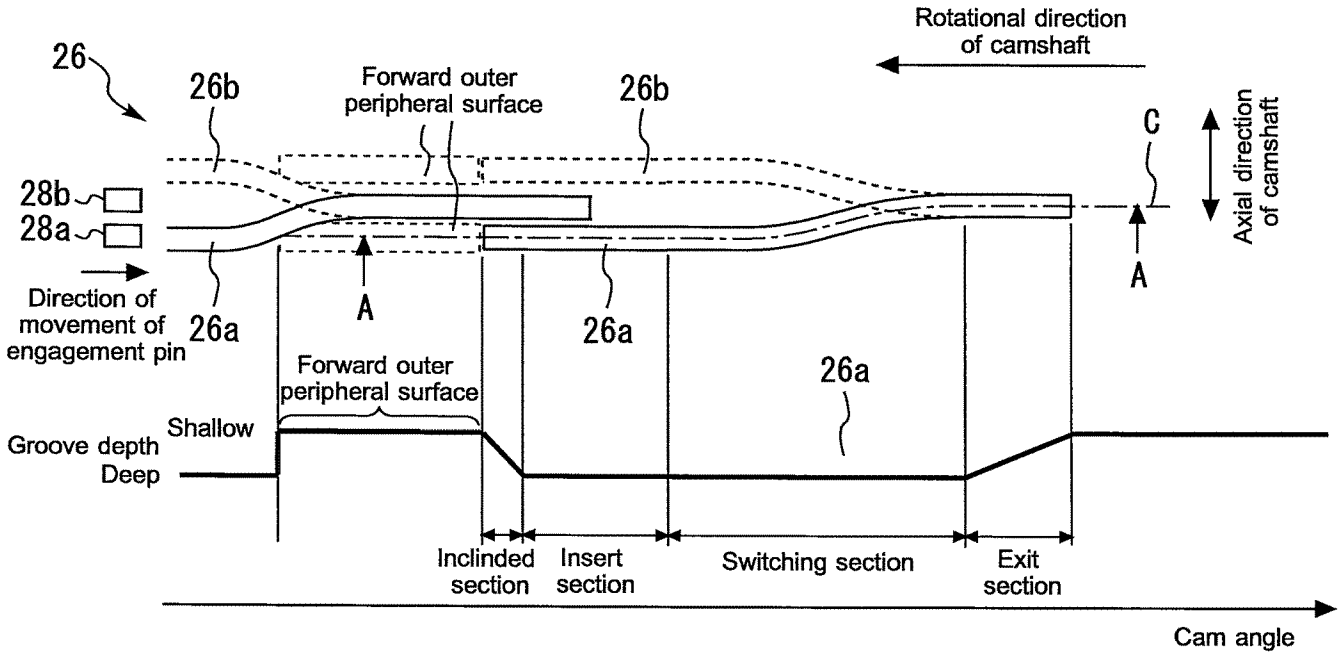
FIGS. 2A and 2B are views for describing a concrete configuration of a cam groove shown in FIG. 1.

FIGS. 2A and 2B are views for describing a concrete configuration of the cam groove 26 shown in FIG. 1. More specifically, FIG. 2A is a view obtained by developing, on a plane, the cam groove 26 formed in the outer peripheral surface of the cam carrier 22. The cam groove 26 is provided as a pair of cam grooves 26*a* and 26*b* corresponding to a pair of engagement pins 28*a* and 28*b* described in detail later. It should be noted that, since the movement of the engagement pin 28 with respect to the cam groove 26 is based on the rotation of the camshaft 12, the direction of the movement is a direction opposite to the rotational direction of the camshaft 12 as shown in FIG. 2A.

Each pair of cam grooves 26*a* and 26*b* is formed so as to extend in the circumferential direction of the camshaft 12, and paths of the cam grooves 26*a* and 26*b* join to each other as shown in FIG. 2A. In more detail, the cam grooves 26*a* and 26*b* are respectively provided corresponding to the engagement pins 28*a* and 28*b*, and each of them includes an "insert section" and a "switching section".

Each of the insert sections is formed so as to extend in a "perpendicular direction" that is perpendicular to the axial direction of the camshaft 12 and such that one of the engagement pins 28*a* and 28*b* is inserted thereinto. The switching section is formed so as to be continuous with one end of the insert section at a location on the rear side with respect to the insert section in the rotational direction of the camshaft 12 and to extend in a direction that is inclined with respect to the perpendicular section. The switching section is provided so as to fall within a section (i.e., a base circle section) in which neither of the intake cams 14 and 16 provided at the cam carrier 22 on which the cam groove 26 having this switching section is formed does not lift the respective intake valves. The switching section of the cam groove 26*a* and the switching section of the cam groove 26*b* are oppositely inclined to each other with respect to the axial direction of the camshaft 12. Moreover, a shared portion of the cam grooves 26*a* and 26*b* in which the paths thereof join corresponds to an "exit direction" in which the engagement pin 28 exits from the cam groove 26.

In FIG. 2A, a movement route C of the engagement pin 28 in association with the rotation of the camshaft 12 is shown. FIG. 2B is a longitudinal sectional view of the cam groove 26*a* that is obtained by cutting the cam carrier 22 along an A-A line in FIG. 2A (that is, along the movement route C of the engagement pin 28). In addition, the longitudinal sectional view of the cam groove 26*b* is similar to this. As shown in FIG. 2B, the groove depths of the insert section and the switching section are constant, as an example. On the other hand, the groove depth of the exit section is not constant and becomes smaller gradually when the position of the groove comes closer to an end of the exit section on the rear side in the rotational direction of the camshaft 12. It should be noted that the cam grooves 26 of the individual cylinders are formed with a phase difference of 90 degrees in cam angle between the adjacent cylinders in order according to the firing order described above.

Moreover, as shown in FIG. 2B, an outer peripheral surface of the cam carrier 22 that corresponds to a part of the outer peripheral surface of the camshaft 12 is located on the forward side with respect to the insert section of the cam groove 26*a* in the rotational direction of the camshaft 12. The outer peripheral surface that is present at this location is herein referred to as a "forward outer peripheral surface", for convenience of explanation. As shown in FIG. 2A, a similar forward outer peripheral surface is present in the vicinity of the cam groove 26*b*.

It should be noted that, in the example shown in FIGS. 2A and 2B, an "inclined section" in which the groove depth gradually changes is provided between the "forward outer peripheral surface" and the "insert section" of each of the cam grooves 26*a* and 26*b*. However, this kind of inclined section may not always be provided to the cam groove according to the present disclosure, and the border between the "forward outer peripheral surface" and the "insert section" may be continuous with each other in a step-wise fashion. In addition, in the cam groove 26 having the inclined section described above, an end of the inclined section on the forward side in the rotational direction of the camshaft 12 corresponds to an "end of the cam groove on the forward side in the rotational direction of the camshaft" according to the present disclosure. On the other hand, in a cam groove without the inclined section, an end of the insert section on the forward side in the rotational direction described above corresponds to this.

(Actuator)

The actuator 24 is fixed to a stationary member 27, such as a cylinder head, at a location that is opposed to the cam groove 26. The actuator 24 is equipped with the engagement pins 28*a* and 28*b* that are capable of engaging with the cam grooves 26*a* and 26*b*, respectively. The actuator 24 is configured in such a way as to be capable of selectively protruding one of the engagement pins 28*a* and 28*b* toward the camshaft 12 (more specifically, toward the cam groove 26).

It should be noted that, as a premise of the cam switching operation, the following positional relation is met among the pair of intake cams 14 and 16, the pair of cam grooves 26*a* and 26*b*, and the pair of the engagement pins 28*a* and 28*b* as shown in FIG. 1. That is, a distance between a groove center line of the insert section of the cam groove 26*a* and a groove center line of the (shared) exit section of the cam grooves 26*a* and 26*b* is a distance D1 and is the same as a distance between a groove center line of the insert section of the cam groove 26*b* and the groove center line of the exit section. Moreover, this distance D1 is the same as each of a distance D2 between center lines of the pair of intake cams 14 and 16 and a distance D3 between center lines of the pair of engagement pins 28*a* and 28*b*.

Figure 3:
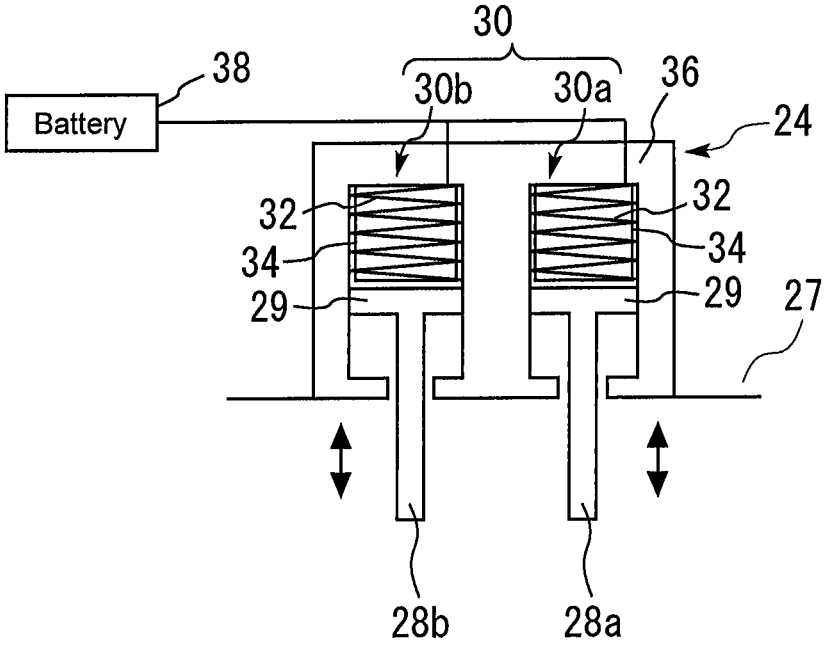
FIG. 3 is a diagram that schematically describes an example of a configuration of an actuator shown in FIG. 1.

FIG. 3 is a diagram that schematically describes an example of a configuration of the actuator 24 shown in FIG. 1. The actuator 24 according to the present embodiment is of an electromagnetic solenoid type, as an example. As shown in FIG. 3, the actuator 24 is equipped with an electromagnet 30 (a pair of electromagnets 30*a* and 30*b*) for the pair of the engagement pins 28*a* and 28*b*. Each of the electromagnets 30*a* and 30*b* includes a coil 32 and a core 34, and is provided in a housing 36 made from metal. The engagement pin 28 is built into the actuator 24. The engagement pin 28 has a plate-like magnetic part 29 that is located at an end of the engagement pin 28 on the side opposed to the electromagnet 30 in the housing 36 and that is formed by a magnetic material.

Electric power is supplied from a battery 38 to each of the electromagnets 30*a* and 30*b*. Control of energization of the actuator 24 (the electromagnet 30) is performed on the basis of a command from an electronic control unit (ECU) 40 described later. The actuator 24 is configured such that, when the energization of the electromagnet 30 is performed, the engagement pin 28 reacts against the electromagnet 30 and is protruded toward the camshaft 12 (the cam carrier 22). Thus, with the energization of the actuator 24 being performed at an appropriate timing described in detail later, the engagement pin 28 can be engaged with the cam groove 26. To be more specific, according to the configuration example of the actuator 24 shown in FIG. 3, if the engagement pin 28 is protruded toward the camshaft 12 as a result of the energization of the actuator 24, the magnetic part 29 of the engagement pin 28 is attracted by a wall surface of the housing 36 located on the side opposite to the electromagnet 30, and is seated on the wall surface. That is, the engagement pin 28 performs a full stroke. Thus, after the engagement pin 28 performs a full stroke, the full stroke state can be maintained without the need of continuation of the energization of the actuator 24.

When the engagement pin 28 that is in engagement with the cam groove 26 enters into the exit section as a result of the rotation of the camshaft 12, the engagement pin 28 is displaced so as to be pushed back to the side of the electromagnet 30 by the effect of the bottom surface in which the groove depth becomes gradually smaller. If the magnetic part 29 of the engagement pin 28 is pushed back, by the effect of this bottom surface, to the side that is closer to the electromagnet 30 than the central position of the stroke of the magnetic part 29, the engagement pin 28 is attracted to the electromagnet 30, and the exit of the engagement pin 28 from the cam groove 26 is completed. Also, if the engagement pin 28 is pushed back in this way, an induced electromotive force is generated at the electromagnet 30*b*. Thus, the ECU 40 can determine whether or not the cam switching operation has completed based on the presence or absence of the detection of this induced electromotive force.

1-4. Control System

The system according to the present embodiment is provided with the ECU 40 as a control device. Various sensors installed in the internal combustion engine 1 and the vehicle on which the internal combustion engine 1 is mounted and various actuators for controlling the operation of the internal combustion engine 1 are electrically connected to the ECU 40.

The various sensors described above include a crank angle sensor 42, an oil temperature sensor 44, a water temperature sensor 46 and an air flow sensor 48. The crank angle sensor 42 outputs a signal responsive to the crank angle. The ECU 40 can obtain an engine speed by the use of the crank angle sensor 42. The oil temperature sensor 44 outputs a signal responsive to the temperature of an oil that lubricates each part of the internal combustion engine 1 (which includes each part (such as, the camshaft 12) of the variable valve operating device 10). The water temperature sensor 46 outputs a signal responsive to the temperature of cooling water that cools the internal combustion engine 1. The air flow sensor 48 outputs a signal responsive to the flow rate of air that is taken into the internal combustion engine 1. Moreover, the various actuators described above include fuel injection valves 50 and an ignition device 52 as well as the actuators 24.

The ECU40 includes a processor, a memory, and an input/output interface. The input/output interface receives sensor signals from the various sensors described above, and also outputs actuating signals to the various actuators described above. In the memory, various control programs and maps for controlling the various actuators are stored. The processor reads out a control program from the memory and executes the control program. As a result, a function of the "control device" according to the present embodiment is achieved.

2. Cam Switching Operation

Next, the cam switching operation with the cam switching device 20 will be described with reference to FIG. 4. Which of the intake cam (small cam) 14 and the intake cam (large cam) 16 is used as the cam that drives the intake valve is determined, for example, in accordance with the engine operating condition (mainly, the engine load and the engine speed Ne) and the magnitude of a change rate of a required torque from the driver.

2-1. Cam Switching Operation from Small Cam to Large Cam

Figure 4:
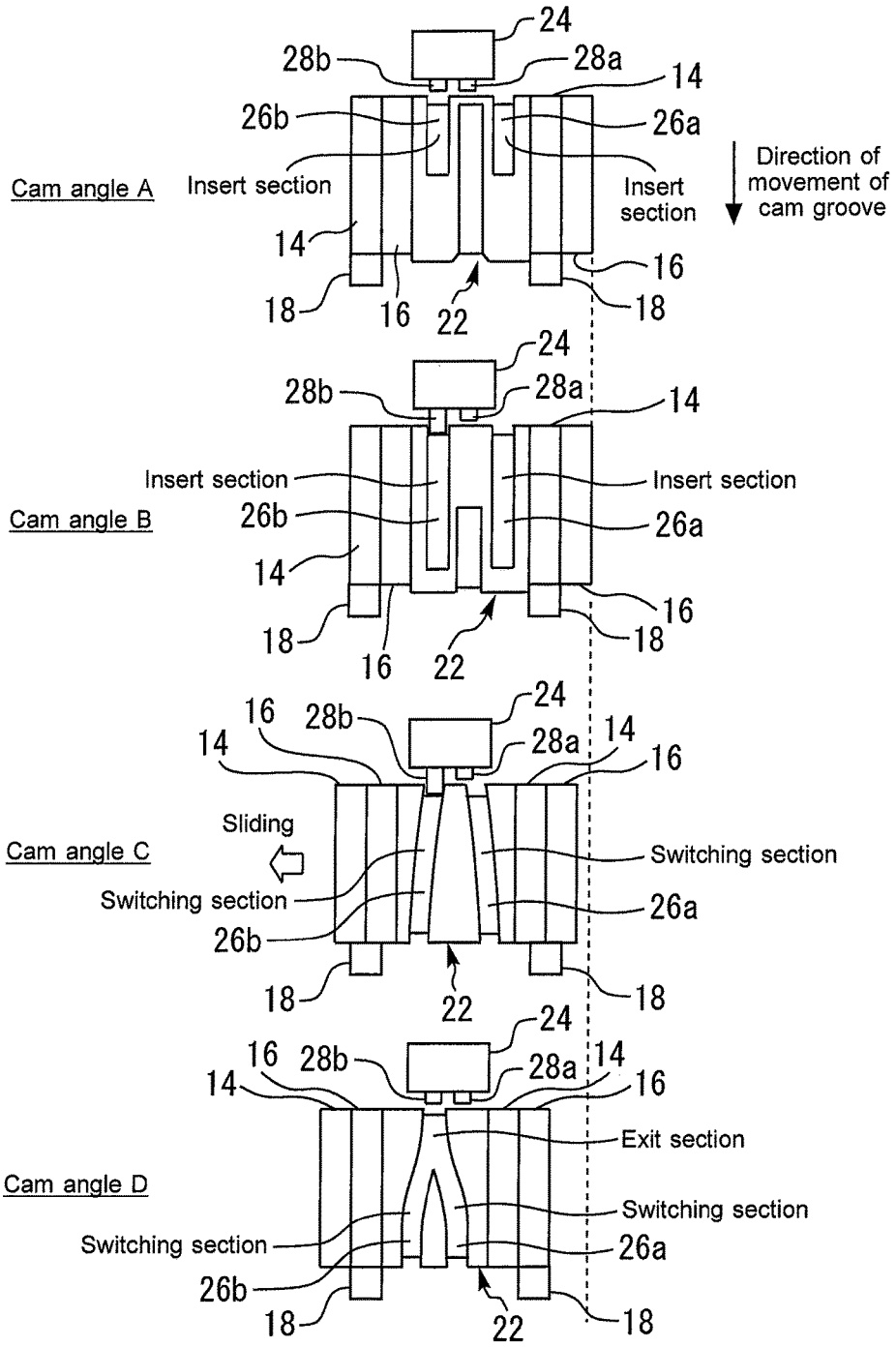
FIG. 4 is a diagram for describing an example of a cam switching operation by a cam switching device.

FIG. 4 is a diagram for describing an example of the cam switching operation by the cam switching device 20. In more detail, the example shown in FIG. 4 corresponds to the cam switching operation performed such that the cam that drives the valve is switched from the intake cam (small cam) 14 to the intake cam (large cam) 16. In FIG. 4, the cam carrier 22 and the actuator 24 at each of cam angles A to D are represented. It should be noted that, in FIG. 4, the cam groove 26 moves from the upper side toward the lower side in FIG. 4 in association with the rotation of the camshaft 12.

In the cam angle A in FIG. 4, the cam carrier 22 is located on the camshaft 12 such that the insert section of the cam groove 26*b* is opposed to the engagement pin 28*b*. In this cam angle A, the energization of the electromagnets 30*a* and 30*b* of the actuator 24 is not performed. Also, in the cam angle A, each of the rocker arms 18 is in contact with the corresponding intake cam 14.

The cam angle B in FIG. 4 corresponds to a cam angle obtained when the camshaft 12 is rotated by 90 degrees from the cam angle A. As a result of the engagement pin 28*b* being protruded toward the camshaft 12 (the cam carrier 22) in response to execution of the energization of the actuator 24 (the electromagnet 30*b*), the engagement pin 28*b* is engaged with the cam groove 26*b* in the insert section. As shown in FIG. 4, in the cam angle B, the engagement pin 28*b* is engaged with the cam groove 26*b* in the insert section.

The cam angle C in FIG. 4 corresponds to a cam angle obtained when the camshaft 12 is rotated further by 90 degrees from the cam angle B. The engagement pin 28*b* enters into the switching section via the insert section as a result of the rotation of the camshaft 12. As shown in FIG. 4, in the cam angle C, the engagement pin 28*b* is in engagement with the cam groove 26*b* in the switching section. Since the engagement pin 28 is located in the switching section in this way, the cam carrier 22 slides to the left side in FIG. 4 from the position corresponding to the cam angle B as a result of the rotation of the camshaft 12, as can be seen by comparing the cam angle B with the cam angle C in FIG. 4.

The cam angle D in FIG. 4 corresponds to a cam angle obtained when the camshaft 12 is rotated further by 90 degrees from the cam angle C. The engagement pin 28*b* enters into the exit section after having passed through the switching section. When the engagement pin 28*b* enters into the exit section, the engagement pin 28*b* is pushed back to the side of the electromagnet 30*b* by the effect of the bottom surface of the exit section as described above. If the engagement pin 28*b* is pushed back, the ECU 40 detects the induced electromotive force of the electromagnet 30*b* to stop the energization of the electromagnet 30*b*. As a result, the engagement pin 28*b* is attracted to the electromagnet 30*b*, and the exit of the engagement pin 28*b* from the cam groove 26*b* is completed. In FIG. 4, the cam carrier 22 and the actuator 24 at the cam angle D at which the exit of the engagement pin 28*b* from the cam groove 26*b* is completed are shown.

Moreover, in the cam angle D in FIG. 4, the sliding operation of the cam carrier 22 to the left side in FIG. 4 is also completed. Thus, the cam switching operation by which the cam that gives a pressing force to the rocker arm 18 is switched to the intake cam (large cam) 16 from the intake cam (small cam) 14 is completed. According to this kind of cam switching operation, switching of the cam can be performed while the camshaft 12 rotates one revolution.

In further addition to this, when the cam switching operation to the intake cam (large cam) 16 from the intake cam (small cam) 14 is completed, the remaining engagement pin 28*a* is opposed to the insert section of the remaining cam groove 26*a* as can be seen from the illustration concerning the cam angle D in FIG. 4.

2-2. Cam Switching Operation to Small Cam from Large Cam

Since the cam switching operation to the intake cam (small cam) 14 from the intake cam (large cam) 16 is similar to the above-described cam switching operation to the intake cam (large cam) 16 from the intake cam (small cam) 14, the description therefor is herein schematically made as follows.

That is, the cam switching operation to the intake cam (small cam) 14 from the intake cam (large cam) 16 is performed when the cam carrier 22 lies at a position similar to the illustration concerning the cam angle D in FIG. 4. First, the energization of the actuator 24 (the electromagnet 30*a*) is performed such that the engagement pin 28*a* is inserted into the insert section of the cam groove 26*a*. Thereafter, during the engagement pin 28*a* passing through the switching section, the cam carrier 22 slides to the right side in FIG. 4 as a result of the rotation of the camshaft 12. Then, when the engagement pin 28*a* has passed through the switching section, the sliding operation of the cam carrier 22 is completed, and the cam that gives a pressing force to the rocker arm 18 is switched to the intake cam (small cam) 14 from the intake cam (large cam) 16. Moreover, the exit of the engagement pin 28*a* from the cam groove 26*a* is performed. It should be noted that, when the cam switching operation is completed in this way, the position of the cam carrier 22 is returned to the position at which the engagement pin 28*b* is opposed to the insert section of the cam groove 26*b*, as with the illustration concerning the cam angle A in FIG. 4.

2-3. Control Mode of Actuator for Insertion of Pin into Cam Groove

Figure 5A:
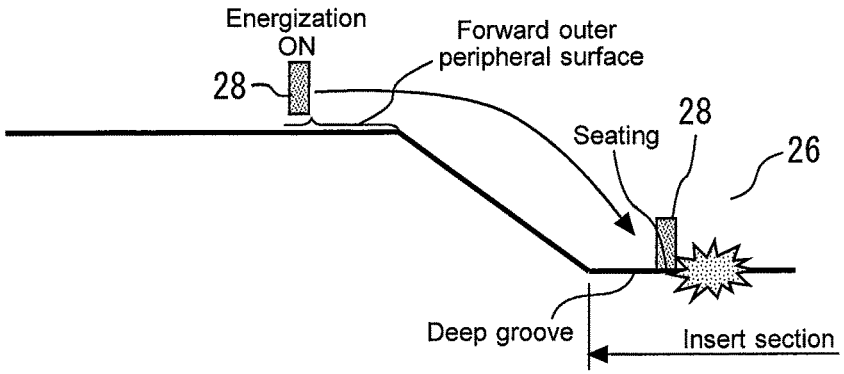
FIGS. 5A to 5C are diagrams for describing the outline of a deep-groove seating mode, an outer-periphery seating mode and a two-time energization mode.
Figure 5B:
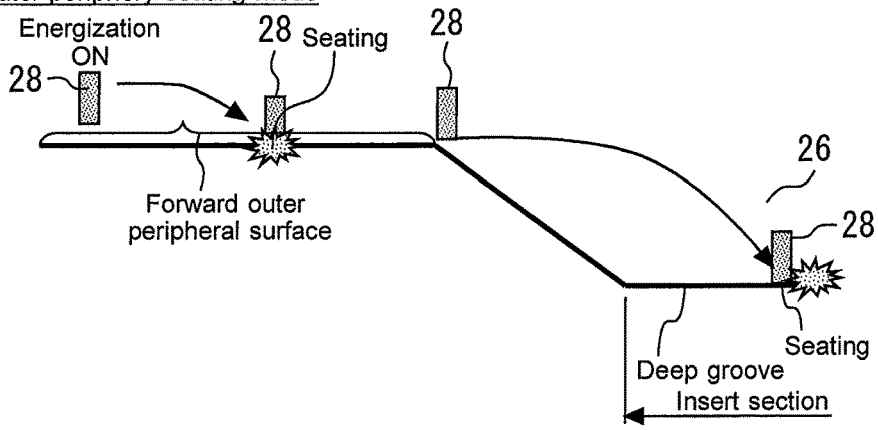
Figure 5C:
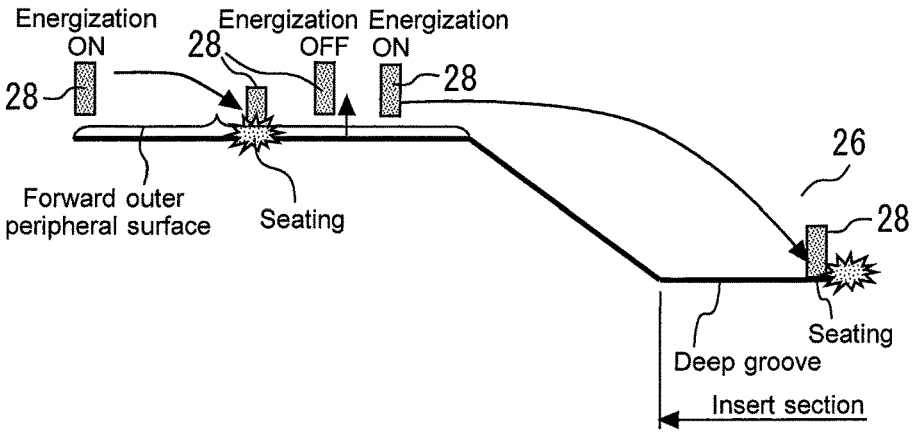

According to the cam switching device 20 described above, the control mode of the actuator 24 for inserting the engagement pin 28 into the cam groove 26 can be selected from a "deep-groove seating mode", an "outer-periphery seating mode" and a "two-time energization mode". In more detail, switching between the "deep-groove seating mode", the "outer-periphery seating mode" and the "two-time energization mode" can be achieved by the ECU 40 controlling the energization timing and the energization period of the actuator 24. FIGS. 5A to 5C are diagrams for describing the outline of the deep-groove seating mode, the outer-periphery seating mode and the two-time energization mode.

2-3-1. Deep-Groove Seating Mode

As shown in FIG. 5A, the deep-groove seating mode corresponds to a mode in which the energization timing of the actuator 24 is controlled such that the engagement pin 28 is directly seated on the bottom surface of the insert section of the cam groove 26 without being seated on the forward outer peripheral surface. It should be noted that, as just described, in the present embodiment, an example in which the distal end of the engagement pin 28 is directly seated on the bottom surface of the insert section of the cam groove 26 when the engagement pin 28 is directly inserted into the inside of the cam groove 26. However, when an engagement pin is caused to be directly inserted into the inside of a cam groove in its insert section in a cam switching device according to the present disclosure, the engagement pin may not always be configured such that the distal end thereof is seated on (comes into contact with) the bottom surface of the engagement pin as with the example described above. More specifically, as long as the engagement pin is inserted into the cam groove, in the example of the actuator 24 shown in FIG. 3, for example, a configuration may alternatively be made such that the magnetic part 29 is seated on the wall surface on the side opposite to the electromagnet 30 without the engagement pin 28 being seated on the bottom surface of the cam groove 26.

2-3-2. Outer-Periphery Seating Mode

As shown in FIG. 5B, the outer-periphery seating mode corresponds to a mode in which the actuator 24 is controlled such that the engagement pin 28 is once seated on the forward outer peripheral surface and then inserted into the cam groove 26 from the forward outer peripheral surface. More specifically, according to the outer-periphery seating mode, the energization of the actuator 24 is started at a timing that is earlier than that when the deep-groove seating mode is used, in order to cause the engagement pin 28 to be once seated on the forward outer peripheral surface. The energization of the actuator 24 is continuously performed until a timing at which the insertion of the engagement pin 28 to the insert section of the cam groove 26 from the forward outer peripheral surface is completed after the engagement pin 28 is once seated on the forward outer peripheral surface.

2-3-3. Two-Time Energization Mode

As shown in FIG. 5C, the two-time energization mode corresponds to a mode that is achieved by performing switching of the control mode to the deep-groove seating mode after the outer-periphery seating mode is started. More specifically, according to the two-time energization mode, similarly to the outer-periphery seating mode, the energization of the actuator 24 is started at a timing that is earlier than that when the deep-groove seating mode is used, in order to cause the engagement pin 28 to be once seated on the forward outer peripheral surface. Also, according to the two-time energization mode, the energization of the actuator 24 is once stopped, after the engagement pin 28 is seated on the forward outer peripheral surface, at a timing that is earlier than the energization timing of the deep-groove seating mode. If the energization of the actuator 24 is stopped in a small stroke state in which the engagement pin 28 is seated on the forward outer peripheral surface, (the magnetic part 29 of) the engagement pin 28 is attracted to the electromagnet 30 and, as a result, the engagement pin 28 is retracted. According to the two-time energization mode, the energization of the actuator 24 is thereafter performed again, at a timing similar to that of the deep-groove seating mode, such that the engagement pin 28 is seated on the bottom surface of the insert section of the cam groove 26.

3. Energization Control of Actuator According to First Embodiment 3-1. Problem Concerning Energization Control of Actuator In a cam switching device that includes an electromagnetic solenoid actuator for causing an engagement pin to be inserted into a cam groove, as with the cam switching device 20 according to the present embodiment, even if the electric voltage applied to a coil of the actuator is constant, the electric current (hereunder, simply referred to as a "coil current I") that flows through the coil to drive the engagement pin becomes different depending on various electric current change factors, such as a change of the temperature of the coil, or variation of a coil resistance value R. In more detail, if, for example, the coil temperature becomes lower, the coil resistance value R decreases, and the value of the coil current I at the same electric voltage thus becomes greater. Because of this, there is a concern that, if the coil temperature becomes greatly lower, the coil current I may become excessively greater and that, as a result, parts around the actuator may be overheated. For example, there is a concern that, if a circuit for driving the actuator is built into an ECU, the ECU may be overheated.

3-2. Outline of Energization Control of Actuator According to First Embodiment

In view of the problem described above, in the present embodiment, the following energization control is performed in order to enable a cam switching operation to be performed while reducing an excessive increase of the coil current I due to various electric current change factors, such as a change of the coil temperature.

3-2-1. Relationship Between Coil Temperature and Coil Current I

Figure 6:
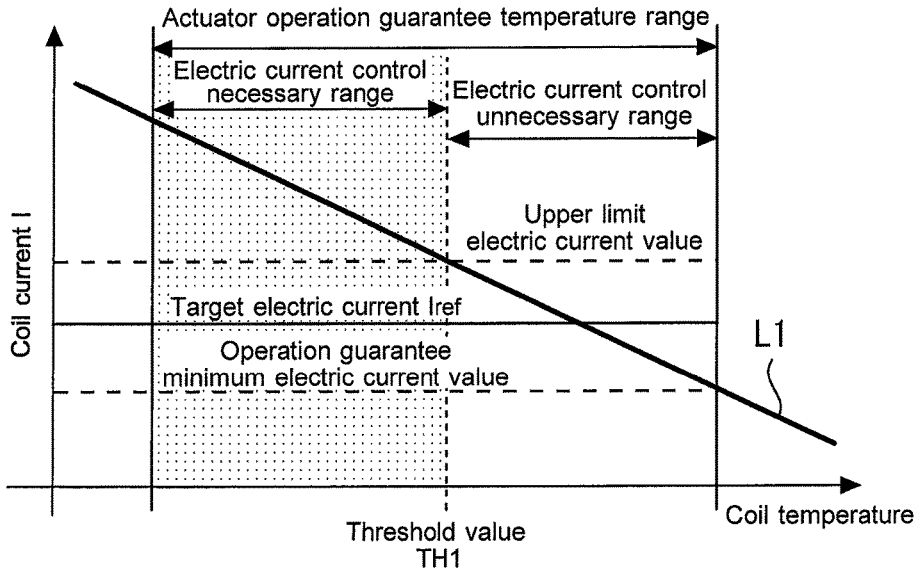
FIG. 6 is a graph that illustrates a relationship between a coil temperature and a coil current I.

FIG. 6 is a graph that illustrates a relationship between the coil temperature and the coil current I. As represented in FIG. 6 as a straight line L1, the coil current I becomes gradually lower as the coil temperature becomes higher. An "actuator operation guarantee temperature range" in FIG. 6 is a design temperature range in which performance of a desired operation of the actuator 24 for the cam switching operation can be guaranteed. Also, an "operation guarantee minimum electric current value" in FIG. 6 is a minimum value of the coil current I necessary for the actuator 24 to perform the desired operation described above, and an "upper limit electric current value" is an upper limit value of the coil current I required in terms of temperature management of parts around the actuator 24 that are subject to reduction of overheat due to the energization of the actuator 24. In the present embodiment, a circuit for driving the actuator 24 is, for example, built into the ECU 40, and one example of the above-described parts supposed in the present embodiment is the ECU 40. Thus, the upper limit electric current value is determined so as to satisfy the restriction on the temperature management of the ECU 40.

Moreover, as shown in FIG. 6, a target electric current Iref that is a target value (a reference value) of the coil current I is determined in advance so as to be a value that is located between the upper limit electric current value and the operation guarantee minimum electric current value (more specifically, a substantially intermediate value of both).

A threshold value TH1 of the coil temperature in FIG. 6 corresponds to a coil temperature value obtained when the coil current I becomes equal to the upper limit electric current value. In a condition where the coil temperature is higher than the threshold value TH1, the coil current I falls below the upper limit electric current value. In this condition, even if the coil temperature is not controlled specially, the coil current I does not exceed the upper limit electric current value. Thus, a coil temperature range on the side that is higher in temperature than the threshold value TH1 corresponds to an "electric current control unnecessary range" in which an electric current control that limits the coil current I is unnecessary.

On the other hand, in a condition where the coil temperature is lower than or equal to the threshold value TH1, if a special control is not performed, the coil current I exceeds the upper limit electric current value. Thus, a coil temperature range on the side that is lower in temperature than the threshold value TH1 corresponds to an "electric current control necessary range" in which an electric current control that limits the coil current I is necessary.

In addition, the relationship between the coil current I and the coil temperature represented by the straight line L1 in FIG. 6 is related to when a battery electric voltage V+B is a standard value. If, for example, the battery electric voltage V+B is lower than this standard value, the value of the coil current I becomes smaller in the overall range of the coil temperature. Thus, the threshold value TH1 changes in accordance with the battery electric voltage V+B. In further addition to this, the "actuator operation guarantee temperature range" in FIG. 6 is a temperature range in which the desired operation of the actuator 24 is guaranteed with taking into consideration a supposed fluctuation of the battery electric voltage V+B.

Figure 7:
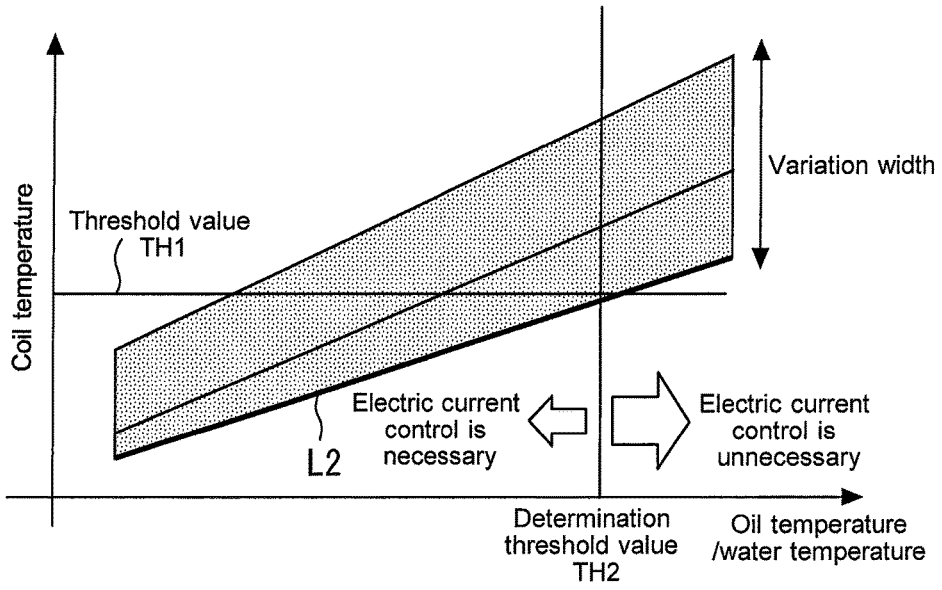
FIG. 7 is a graph that illustrates a relationship between an oil temperature/water temperature of the internal combustion engine and the coil temperature.

3-2-2. Estimation of Coil Temperature Based on Oil Temperature/Water Temperature FIG. 7 is a graph that illustrates a relationship between an oil temperature/water temperature of the internal combustion engine 1 and the coil temperature. The relationship between the oil temperature and the coil temperature and the relationship between the water temperature and the coil temperature are similar to each other. Thus, in FIG. 7, the horizontal axis thereof indicates the oil temperature/water temperature, and these two relationships are inclusively represented.

The coil temperature has a correlation with each of the oil temperature and the water temperature with a variation. In more detail, the value of the coil temperature that corresponds to each value of the oil temperature/water temperature becomes higher with a variation width as shown in FIG. 7 when the oil temperature is higher, and similarly becomes higher with a variation when the water temperature is higher. As described with reference to FIG. 6, if the coil temperature becomes lower, limiting the coil current I is highly requested. Thus, in the present embodiment, a lower limit value of the variation width of the coil temperature that corresponds to each value of the oil temperature/water temperature in FIG. 7 is used, for the control of the coil current I, as follows.

A straight line L2 shown in FIG. 7 is obtained by joining the lower limit values in the variation width of the coil temperature that corresponds to each value of the oil temperature/water temperature. On that basis, a determination threshold value TH2 of the oil temperature/water temperature in FIG. 7 is a value of the oil temperature/water temperature obtained when the coil temperature described above becomes equal to the threshold value TH1. Thus, by grasping in advance, the straight line L2 in FIG. 7 and determining the determination threshold value TH2, it can be determined, on the basis of the value of the oil temperature/water temperature, whether or not the electric current control for causing the coil current I to fall below the upper limit electric current value is required. In more detail, it can be determined that, if the value of the oil temperature/water temperature is higher than the threshold value TH2, the electric current control is not necessary, and it can be determined that, if the value of the oil temperature/water temperature is smaller than or equal to the threshold value TH2, the electric current control is necessary.

Furthermore, in the present embodiment, a relationship between the lower limit values in the variation width of the coil temperature represented by the straight line L2 and the oil temperature/water temperature is obtained in advance by, for example, an experiment and is stored as a map in the ECU 40. Also, the coil temperature (lower limit value) depending on the oil temperature/water temperature is estimated by the use of this map. The estimated coil temperature is used in the following estimation processing of the coil current I. It should be noted that, contrary to the example described above, the coil temperature (lower limit value) may alternatively be estimated as a value depending on either one of the oil temperature and the water temperature.

3-2-3. Estimation Processing of Coil Current I (Calculation Processing of Iest)

Figure 8:
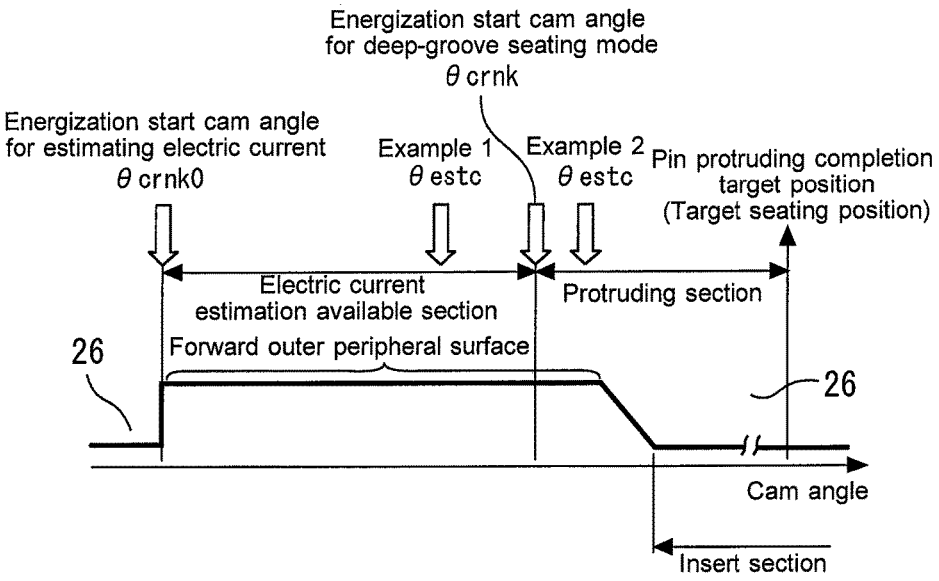
FIG. 8 is a diagram for describing an electric current estimation available section that is subject to execution of an estimation processing of the coil current I.

FIG. 8 is a diagram for describing an electric current estimation available section that is subject to execution of the estimation processing of the coil current I. This electric current estimation processing is performed by the use of the outer-periphery seating mode when a cam switching request for executing the cam switching operation is made.

(Determination E1 on Execution of Electric Current Estimation Processing)

An energization start cam angle (for estimating the electric current) θcrnk0 corresponds to a value of the crank angle associated with a timing at which the energization of the actuator 24 starts for this electric current estimation processing. This energization start cam angle θcrnk0 corresponds to an end on the advance side of the forward outer peripheral surface, that is, a position that can be most advanced when the cam switching operation is performed by the use of the outer-periphery seating mode at a combustion cycle On the other hand, an energization start cam angle θcrnk in FIG. 8 is a value of the cam angle associated with an energization start timing that is required for the engagement pin 28 to be able to be seated at a pin protruding completion target position (in other words, a target seating position within the insert section) when the deep-groove seating mode is used.

If the energization is started at a cam angle on the side retarded more than the energization start cam angle θcrnk described above, success of the cam switching operation cannot be ensured. In other words, a cam angle range from the energization start cam angle (for estimating the electric current) θcrnk0 to the energization start cam angle θcrnk (for the deep-groove seating mode) corresponds to the "electric current estimation available section" that is capable of executing the electric current estimation processing. It should be noted that a cam angle range from the energization start cam angle θcrnk (for the deep-groove seating mode) to the pin protruding completion target position corresponds to a "protruding section" for protruding the engagement pin 28 toward the cam groove 26 during the deep-groove seating mode.

In further addition to this, if the engine speed Ne (proportional to the camshaft rotation speed) becomes higher, the amount of change in the crank angle per unit time and the amount of the cam angle in accompaniment therewith become greater. Thus, the energization start cam angle θcrnk is changed in accordance with the engine speed Ne and, more specifically, is more advanced when the engine speed Ne is higher. Moreover, if the viscosity of the oil for lubricating each parts of the internal combustion engine 1 (including each parts of the variable valve operating device 10, such as the camshaft 12) is low due to the temperature of the oil being low, the protruding operation of the engagement pin 28 becomes easy to be hampered by the oil. Thus, the energization start cam angle θcrnk is changed in accordance with the temperature of the oil and, more specifically, is more advanced when the temperature of the oil is lower. Therefore, the electric current estimation available section and the protruding section change in accordance with the engine speed Ne and the temperature of the oil.

In the electric current estimation processing described above requires a value of the coil current I obtained at a timing at which a certain time X (ms (millisecond)) has elapsed from a time point (an energization start timing) associated with the energization start cam angle (for estimating the electric current) θcrnk0 in order to obtain an estimated electric current value Iest of the coil current I depending on the current coil temperature (an estimated value based on the relationship shown in FIG. 7), although the detail thereof will be described later. It takes a longer time to protrude the engagement pin 28 toward the bottom surface of the cam groove 26 during the outer-periphery seating mode as compared to during the deep-groove seating mode. This is because, during the outer-periphery seating mode, the protruding speed of the engagement pin 28 once becomes zero when the engagement pin 28 is seated on the forward outer peripheral surface, and accelerates again from a state of zero initial speed as shown in FIG. 5B after having passed through the forward outer peripheral surface. Thus, there is the possibility that, if the energization start cam angle θcrnk (for the deep-groove seating mode) arrives during the certain time X when the outer-periphery seating mode is performed for the electric current estimation processing, the engagement pin 28 may not be able to protrude the engagement pin 28 within the insert section while preventing the delay of the combustion cycle at which the cam switching operation is performed.

Accordingly, in the present embodiment, the determination E1 on execution of the electric current estimation processing is performed before the electric current estimation processing is started. This determination E1 is performed on the basis of whether or not an electric current estimation completion cam angle θestc (a prediction value) that is a cam angle obtained when the certain time X that starts from the energization start timing elapses is equal to or more advanced than the energization start cam angle θcrnk (for the deep-groove seating mode).

Figure 9:
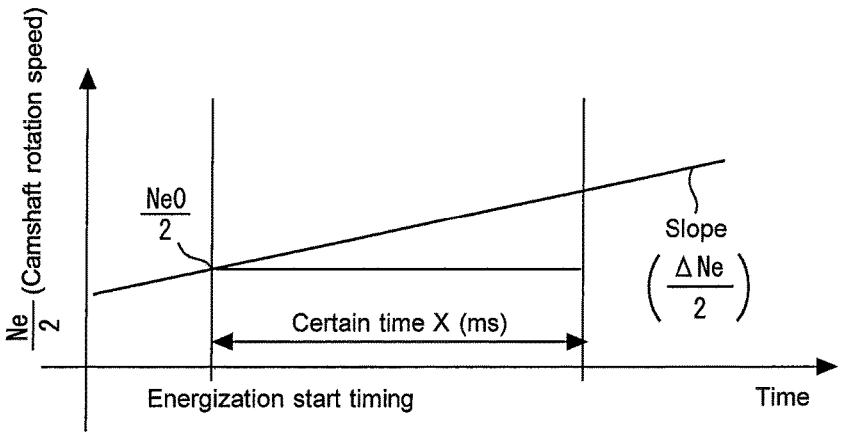
FIG. 9 is a graph that illustrates a relationship between the rotation speed (Ne/2) of a camshaft and time.

FIG. 9 is a graph that illustrates a relationship between the rotation speed (Ne/2) of the camshaft 12 and time. An engine speed Ne0 (deg/ms) at a time point (the energization start timing) associated with the energization start cam angle (for estimating the electric current) θcrnk0 and a change rate ΔNe (deg/ms$^2$) of engine speed can be calculated on the basis of the outputs of the crank angle sensor 42. Since, as a result, the camshaft rotation speed (Ne0/2) at the energization start timing and the change rate (ΔNe/2) of the camshaft rotation speed can be grasped as shown in FIG. 9, the transition of the camshaft rotation speed during the certain time X can be grasped.

The left-hand side of the following formula 1 (inequality) corresponds to the electric current estimation completion cam angle θestc. To be more specific, in the present embodiment, the electric current estimation completion cam angle θestc is, as an example, calculated, in accordance with the relationship represented in this left-hand side, that is, on the basis of the camshaft rotation speed (Ne0/2) at the energization start timing and the change rate (ΔNe/2) of the camshaft rotation speed. Also, as shown in formula 1, it is determined whether or not the electric current estimation completion cam angle θestc is equal to or smaller than the energization start cam angle θcrnk (for the deep-groove seating mode) (that is, whether or not the cam angle θestc is equal to or more advanced than the cam angle θcrnk).

$$\int_0^x \left(\frac{1}{2}Ne0 + \frac{1}{2}\Delta Ne \cdot t\right)dt = \frac{1}{2}Ne0 \cdot x + \frac{1}{4}\Delta Ne \cdot x^2 \leq Tcrnk \quad (1)$$

$t$: time (ms)

In the present embodiment, as in an example 1 shown in FIG. 8, if the electric current estimation completion cam angle θestc is equal to or more advanced than the cam angle θcrnk, the electric current estimation processing described above is performed. On the other hand, as in an example 2, if the electric current estimation completion cam angle θestc is more retarded than the energization start cam angle θcrnk, the energization is performed at the energization start cam angle θcrnk without execution of the electric current estimation processing described above (that is, without execution of an accurate estimation of the coil current I depending on the coil temperature) and, as a result, the deep-groove seating mode is performed.

(Calculation of Estimated Electric Current Value Iest)

Figure 10:
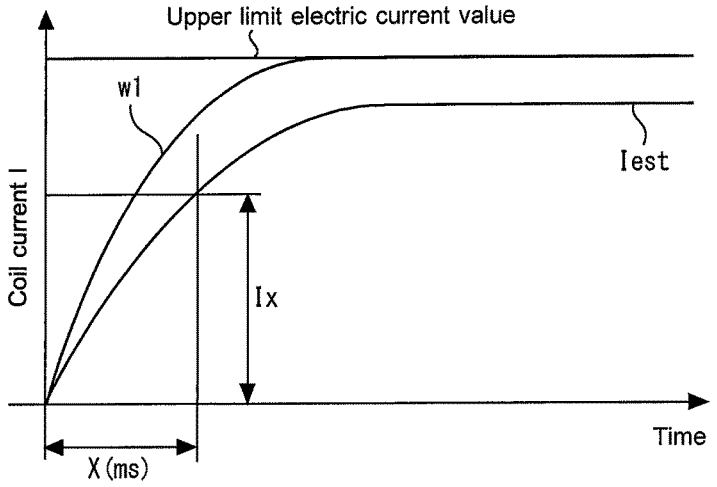
FIG. 10 is a graph for describing an example of calculation method of an estimated electric current value Iest.

FIG. 10 is a graph for describing an example of calculation method of the estimated electric current value Iest. As a premise, according to the electric current estimation processing of the present embodiment, the energization at the energization start cam angle (for estimating the electric current) θcrnk0 is performed by, for example, applying an electric voltage to the coil 32 with the duty ratio of 100%. More specifically, since the battery electric voltage V+B is applied to the coil 32, in this energization, the average electric voltage per unit time by the duty control is equal to the electric voltage value V+B.

If the battery electric voltage V+B is applied to the coil 32, as shown in FIG. 10, the coil current I continues to increase with a lapse of time and finally converges. This convergence value corresponds to the estimated electric current value Iest. In regard to the characteristics of increase of the coil current I as shown in FIG. 10, there is a knowledge that, if the value of electric current at a time point at which a certain time has elapsed from the start of the energization is found, the convergence value of the electric current can be found. The certain time X described above corresponds to the certain time mentioned here. Thus, by preparing a map that identifies in advance a relationship between an electric current value Ix at the time point at which the certain time X has elapsed and the convergence value, the convergence value according to the electric current value Ix that is measured during operation of the internal combustion engine 1 (i.e., the estimated electric current value Iest) can be obtained. In more detail, the relationship between the electric current value Ix and the convergence value changes in accordance with the coil temperature and the applied electric voltage (battery electric voltage V+B). Therefore, the map described above is determined such that map values differ depending on the coil temperature and the applied electric voltage. It should be noted that the certain time X is determined so as to be shorter than a time required for the coil current I to reach the convergence value even if the coil current I has any value within ranges of the coil temperature and the applied electric voltage that are supposed. Moreover, the coil current I can be measured by the use of, for example, an electric current sensor built into the ECU 40.

Contrary to the method that uses this kind of electric current value Ix, it is conceivable to detect the convergence value itself by continuously measuring the coil current I until the convergence value is obtained. However, according to such a method, there is the possibility that the coil current I may exceed the upper limit electric current value (see FIG. 6) as with the waveform W1 shown in FIG. 10 depending on values of the coil temperature or the applied electric voltage. In contrast to this, according to the method that uses the electric current value Ix, the estimated electric current value Iest can be calculated while avoiding that the coil current I exceeds the upper limit electric current value during measurement of the coil current I.

3-2-4. Calculation of Target Duty Ratio Dutyref

The target duty ratio Dutyref is a target value of the duty ratio of the electric voltage applied to the actuator 24 (that is, a ratio of an electric voltage applying time with respect to a predetermined period). In order to prevent the coil current I greater than the upper limit electric current value from flowing, the target duty ratio Dutyref is calculated as a value that changes in accordance with the estimated electric current value Iest as described below. First, a coil resistance value Rest is herein calculated to calculate the target duty ratio Dutyref. The coil resistance value Rest can be calculated as shown in the following formula 2 on the basis of the battery electric voltage V+B and the estimated electric current value Iest obtained by the electric current estimation processing performed under the duty ratio of 100% (that is, under a condition in which the average applied electric voltage per unit time is equal to the battery electric voltage V+B).

$$R_{est} = \frac{V + B}{I_{est}} \quad (2)$$

Moreover, it can be said that the target duty ratio Dutyref is a parameter that determines the average applied electric voltage per unit time under a condition in which the battery electric voltage V+B is applied. The target duty ratio Dutyref is identified as a value obtained by dividing a product of the target electric current Iref (see FIG. 6) and the coil resistance value Rref by the battery electric voltage V+B as shown in the following formula 3. Then, by deforming formula 3 with taking into consideration the relationship of formula 2 described above, the target duty ratio Dutyref is finally identified as a value obtained by dividing the target electric current Iref by the estimated electric current value Iest.

$$Duty_{ref} = \frac{(I_{ref} \times R_{est})}{V + B} \times 100 = \frac{I_{ref}}{I_{est}} \times 100 \quad (3)$$

According to formula 3 described above, the target duty ratio Dutyref is calculated, under a certain battery electric voltage V+B and a certain target electric current Iref, so as to be lower when the coil resistance value Rref is smaller (that is, the coil temperature is lower). Also, according to formula 3, if the product of the target electric current Iref and the coil resistance value Rref is greater than the value of the battery electric voltage V+B (in other words, if the estimated electric current value Ist is smaller than or equal to the target electric current Iref), the target duty ratio Dutyref is fixed at 100% that is the upper limit value. If, on the other hand, the estimated electric current value Iest is greater than the target electric current Iref, the target duty ratio Dutyref is limited so as to be lower when the estimated electric current value Iest is greater (that is, the coil temperature is lower).

According to the target duty ratio Dutyref determined as described above, the average electric voltage per unit time applied to the actuator 24 is lowered more when the estimated electric current value Iest is greater. It should be noted that the processing to decrease the target duty ratio Dutyref is performed such that the coil current I does not fall below the operation guarantee minimum electric current value (see FIG. 6) even if the coil current I is limited by lowering the average electric voltage.

3-2-5. Determination E2 on Continuation of Outer-Periphery Seating Mode

Figure 11A:
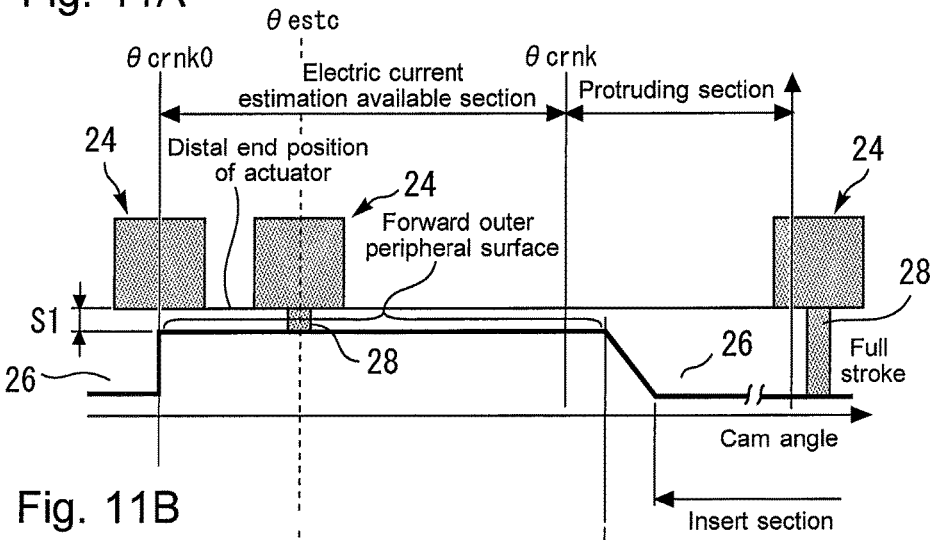
FIGS. 11A and 11B are diagrams for describing a relationship between an outer-periphery seating position and a full stroke response time T_oland.
Figure 11B:
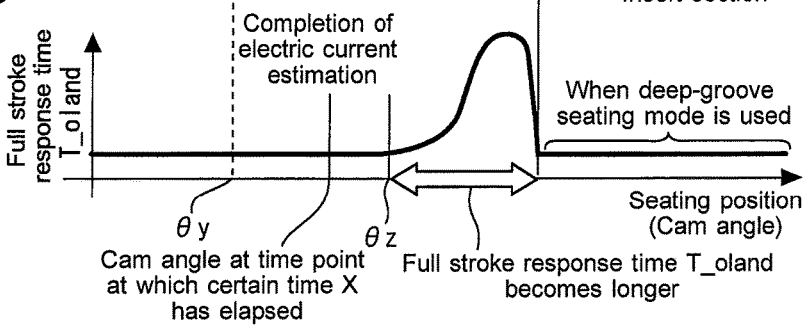

FIGS. 11A and 11B are diagrams for describing a relationship between an outer-periphery seating position and a full stroke response time T_oland. A cam angle obtained when the engagement pin 28 is seated on the forward outer peripheral surface by the use of the deep-groove seating mode also refers to an "outer-periphery seating position" for convenience of description. Also, seating of the engagement pin 28 on the forward outer peripheral surface simply refers to an "outer-periphery seating".

The full stroke response time T_oland is a time required for the engagement pin 28 to perform a full stroke. In more detail, if the engagement pin 28 is once seated on the forward outer peripheral surface by the use of the outer-periphery seating mode, the full stroke response time T_oland corresponds to a sum of a time required for the outer-periphery seating and a time required for the engagement pin 28 to perform a stroke toward the bottom surface of the cam groove 26 from the forward outer peripheral surface thereafter. It should be noted that, in other words, the time required for the outer-periphery seating is a time required for the engagement pin 28 to perform a stroke by a stroke S1 that corresponds to a distance to the forward outer peripheral surface from the distal end of the engagement pin 28 that is located during the energization being OFF. In addition, the full stroke response time T_oland corresponds to a "time required from a start of the protruding operation of the engagement pin toward the inside of the cam groove until a completion thereof".

The full stroke response time T_oland obtained when the engagement pin 28 is seated on the forward outer peripheral surface changes in accordance with the outer-periphery seating position as described below. The horizontal axes of FIGS. 11A and 11B each denote a cam angle, and, on that basis, FIG. 11B represents a relationship between the full stroke response time T_oland and the outer-periphery seating position. According to the relationship shown in FIG. 11B, if the outer-periphery seating position is closer to the energization start cam angle θcrnk0, the full stroke response time T_oland has a short value similar to that when the deep-groove seating mode is used. In contrast to this, if the outer-periphery seating position is retarded as compared to a cam angle θz in FIG. 11B due to, for example, a reason that the battery electric voltage V+B is low, the full stroke response time T_oland rapidly becomes long. The reason why the outer-periphery seating position is retarded as just described is that the coil current I is small and the full stroke response time T_oland thus becomes longer when the outer-periphery seating position is retarded.

If the deep-groove seating mode is continuously used in a condition in which the full stroke response time T_oland is too long as described above, it becomes difficult to seat the engagement pin 28 at a predetermined pin protruding completion target position (see FIG. 8) in the cam groove 26. As a result, there is the possibility that the cam switching operation may fail. Accordingly, if the deep-groove seating mode accompanied by the setting of the target duty ratio Dutyref based on the electric current estimation processing described above is used, the determination E2 on continuation of the outer-periphery seating mode is performed in a manner as described below in order to ensure that the cam switching operation does not fail even if the limitation of the target duty ratio Dutyref is performed.

(Detail of Determination E2 on Continuation of Outer-Periphery Seating Mode)

Figure 12:
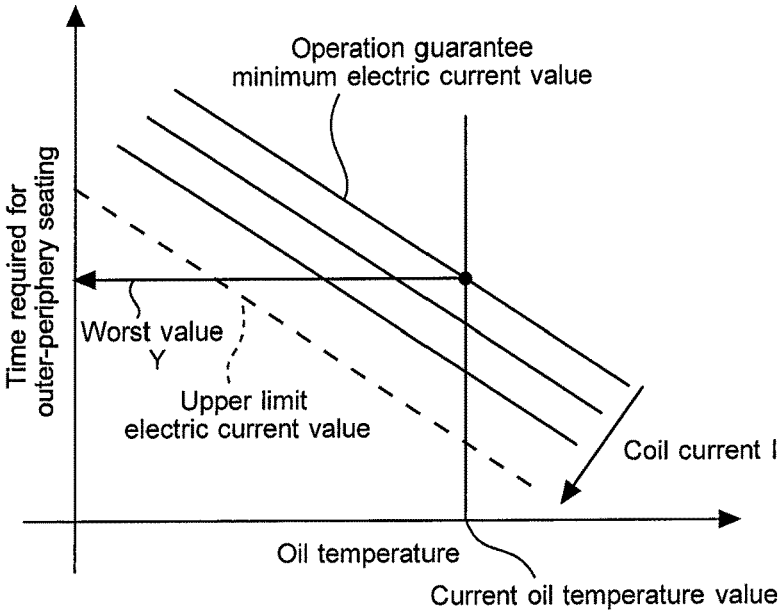
FIG. 12 is a graph that represents a relationship between a time required for an outer-periphery seating (i.e., a time required for the stroke of S1), and an oil temperature and the coil current I.

FIG. 12 is a graph that represents a relationship between a time required for the outer-periphery seating (i.e., a time required for the stroke of S1), and the oil temperature and the coil current I. As shown in FIG. 12, the time required for the outer-periphery seating becomes longer when the oil temperature is lower. This is because, if the viscosity of the oil is low due to the oil temperature being low, the protruding operation of the engagement pin 28 becomes easy to be hampered by the oil. Also, as shown in FIG. 12, a time required for the outer-periphery seating under the same oil temperature becomes longer when the coil current I is lower.

A relationship as shown in FIG. 12 is obtained in advance by experiment, for example, and a map that defines the relationship is stored in the ECU 40. According to the determination E2 on continuation of the outer-periphery seating mode, first, a time required for the outer-periphery seating when the electric current of the operation guarantee minimum electric current value (see FIG. 6) flows through the coil 32 under the current oil temperature detected by the use of the oil temperature sensor 44 (that is, a worst value Y (ms) of the time required for the outer-periphery seating under the current oil temperature) is obtained from the map that defines the relationship as shown in FIG. 12.

In FIGS. 11A and 11B, an example in which the engagement pin 28 is seated on the forward outer peripheral surface with the worst value Y described above is represented. θy in FIG. 11B is one example of the value of the cam angle obtained when the worst value Y from the energization start cam angle θcrnk0 elapses. According to the determination E2 described above, the outer-periphery seating position in a condition in which the worst value Y is required for the outer-periphery seating is estimated by calculating the value of this cam angle θy by the use of formula 1 described above.

A relationship between the full stroke response time T_oland and the outer-periphery seating position as shown in FIG. 11B is obtained in advance by experiment, for example, and a map that defines the relationship is stored in the ECU 40. In more detail, the peak value of the full stroke response time T_oland changes in accordance with the battery electric voltage V+B and the oil temperature. Thus, this map is determined such that map values change in accordance with the battery electric voltage V+B and the oil temperature. According to the determination E2 described above, the value of the full stroke response time T_oland depending on the cam angle θy calculated as described above is obtained from this kind of map.

Figure 13:
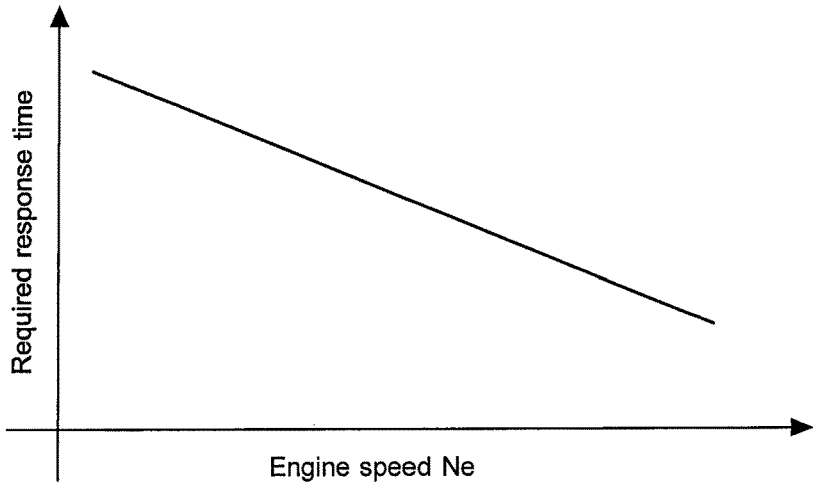
FIG. 13 is a graph that illustrates a relationship between a required response time and an engine speed Ne.

FIG. 13 is a graph that illustrates a relationship between a required response time and the engine speed Ne. This required response time refers to a required value of a time (a response time) required for a full stroke of the engagement pin 28 in order to ensure success of the cam switching operation. The higher the engine speed Ne is, the greater the amount of change of the cam angle per unit time becomes. Thus, as shown in FIG. 13, the higher the engine speed Ne (proportional to the camshaft rotation speed) is, the shorter the required response time becomes. It should be noted that the required response time corresponds to a "certain time" according to the present disclosure.

According to the determination E2 described above, the full stroke response time T_oland obtained (estimated) while supposing the worst value Y described above is compared to the required response time depending on the engine speed Ne. Then, if this full stroke response time T_oland is shorter than or equal to the required response time, it is determined that the cam switching operation that uses the outer-periphery seating mode is available. Also, if the full stroke response time T_oland is shorter than or equal to the required response time, the target duty ratio Dutyref is changed, from 100% that is set at the start of the energization, to a value depending on the estimated electric current value Iest according to formula 3 described above (more specifically, a value of the electric current that is limited such that the coil current I does not exceed the upper limit electric current value (see FIG. 6)). As a result, the engagement pin 28 is protruded into the cam groove 26 while the deep-groove seating mode is continuously used.

Moreover, according to the determination E2 described above, if, conversely, the full stroke response time T_oland associated with the worst value Y described above is longer than the required response time, it is determined that the cam switching operation that uses the outer-periphery seating mode is not available. Also, if the full stroke response time T_oland is longer than the required response time, the energization of the actuator 24 is once turned OFF. As a result, the engagement pin 28 that is seated on the forward outer peripheral surface is retracted. The energization of the actuator 24 is performed again thereafter at a timing at which the energization start cam angle θcrnk arrives. In other words, the two-time energization mode described above is performed and the engagement pin 28 is finally inserted into the cam groove 26 by the use of the deep-groove seating mode. Also, the target duty ratio Dutyref (the value depending on the estimated electric current value Iest) is used.

As described so far, the cam switching operation that uses the deep-groove seating mode accompanied by the limitation of the coil current I based on the electric current estimation processing described above is performed only if the result of the determination E2 is positive.

Figure 14:
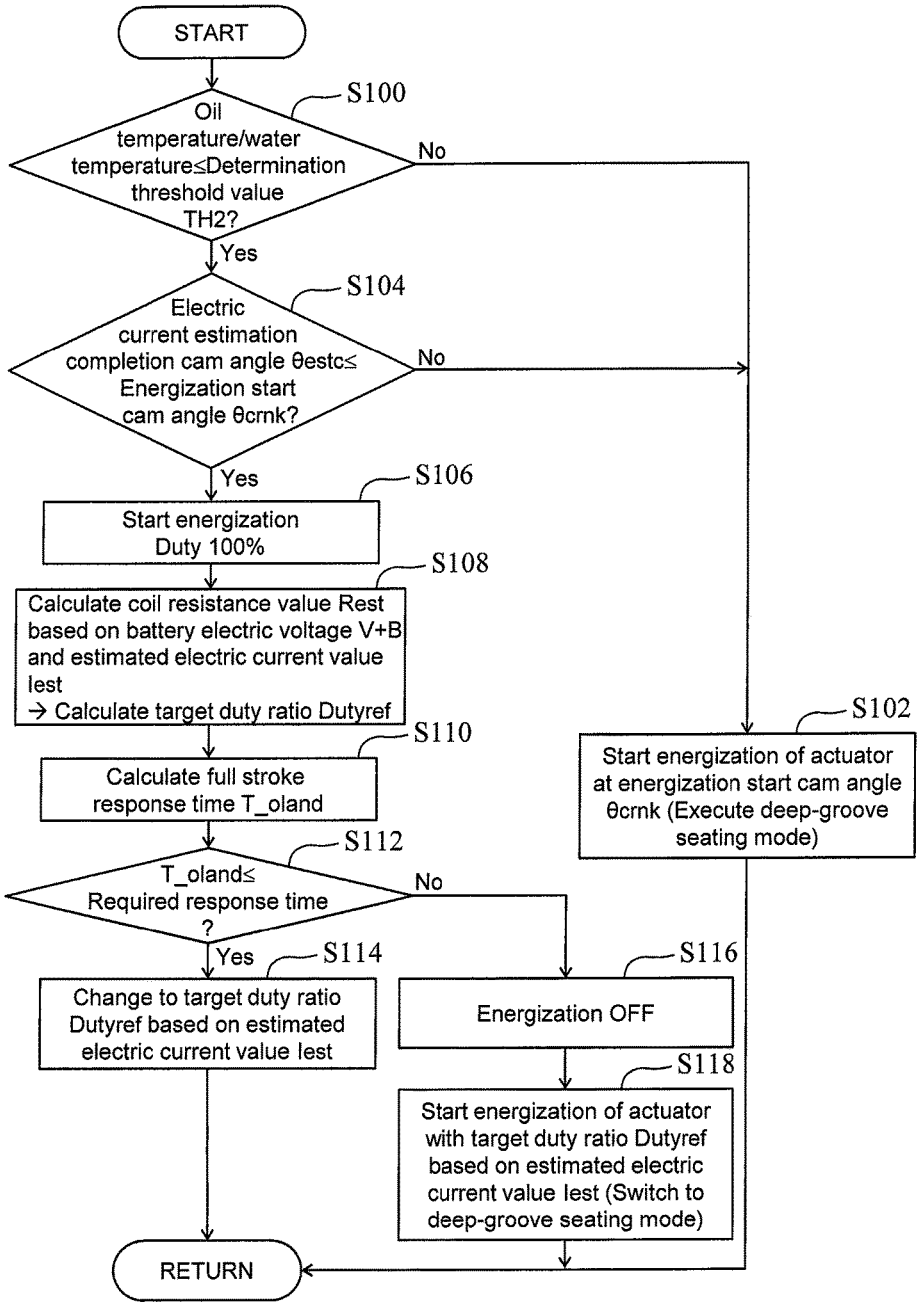
FIG. 14 is a flow chart that illustrates a routine of the processing concerning energization control of the actuator according to the first embodiment of the present disclosure.

3-3. Processing of ECU Concerning Energization Control of Actuator According to First Embodiment FIG. 14 is a flow chart that illustrates a routine of the processing concerning the energization control of the actuator 24 according to the first embodiment of the present disclosure. It should be noted that the present routine is performed in response to a receipt of a cam switching request. The cam switching request is made when, for example, a required intake cam (the small cam 14 or the large cam 16) changes in accordance with a change of the engine operating condition (mainly, the engine load and the engine speed Ne).

According to the routine shown in FIG. 14, first, the ECU 40 determines whether or not the oil temperature/water temperature is lower than or equal to the determination threshold value TH2 (see FIG. 7) (step S100). To be more specific, it is determined whether or not the oil temperature obtained by the use of the oil temperature sensor 44 is lower than or equal to an oil temperature threshold value that corresponds to the determination threshold value TH2, and it is also determined whether or not the water temperature obtained by the use of the water temperature sensor 46 is lower than or equal to a water temperature threshold value that corresponds to the determination threshold value TH2. As a result, if at least one of the result of the determination concerning the oil temperature and the result of the determination concerning the water temperature is positive, the result of the determination of step S100 becomes positive. It should be noted that, contrary to this kind of example, only one of the determinations concerning the oil temperature and the water temperature may alternatively be performed.

If the result of the determination of step S100 is negative, that is, if it can be judged that the control to limit the coil current I so as not to exceed the upper limit electric current value (see FIG. 6) is not necessary, the ECU 40 starts the energization of the actuator 24 at a timing at which the energization start cam angle θcrnk arrives (step S102). That is, the deep-groove seating mode is performed. In the ECU 40, a map (not shown in the drawings) that defines in advance a relationship between the oil temperature/water temperature and the target duty ratio Dutyref. In this step S102, the ECU 40 obtains the target duty ratio Dutyref depending on the current oil temperature/water temperature from this kind of map, and controls the energization of the actuator 24 by the use of the obtained target duty ratio Dutyref. It should be noted that, contrary to the example described above, the target duty ratio Dutyref may alternatively be obtained as a value depending on either one of the oil temperature and the water temperature.

If, on the other hand, the result of the determination of step S100 is positive, that is, if it can be judged that the control to limit the coil current I so as not to exceed the upper limit electric current value (see FIG. 6) is necessary, the ECU 40 proceeds to step S104.

The processing of step S104 corresponds to the processing concerning the determination E1 on execution of the electric current estimation processing described above. That is, in step S104, the ECU 40 determines whether or not the electric current estimation completion cam angle θestc calculated in the manner as described above is equal to or more advanced than the energization start cam angle θcrnk (for the deep-groove seating mode).

If the result of the determination of step S104 is negative, that is, if it can be judged that there is the possibility that, if the electric current estimation processing that uses the deep-groove seating mode is performed, the engagement pin 28 may not be able to be protruded into the insert section of the cam groove 26 in the current combustion cycle, the ECU 40 proceeds to step S102 and performs the deep-groove seating mode. If, on the other hand, the result of the determination of step S104 is positive, that is, if it can be judged that, even if the electric current estimation processing that uses the deep-groove seating mode is performed, the engagement pin 28 can be protruded into the insert section of the cam groove 26 in the current combustion cycle, the ECU 40 starts the energization of the actuator 24 with the duty ratio of 100% at a timing at which the energization start cam angle θcrnk0 arrives (step S106).

Next, the ECU 40 performs the processing of step S108. The ECU 40 is configured to be able to detect the battery electric voltage V+B. In step S108, first, the ECU 40 obtains the current battery electric voltage V+B and also calculates, by the use of the electric current estimation processing described above, the estimated electric current value Iest in which the coil temperature is taken into consideration. In addition, calculation of the estimated electric current value Iest in step S108 is performed at a timing at which the certain time X described above has elapsed. In step S108, the ECU 40 then calculates the coil resistance value Rest by dividing the battery electric voltage V+B by the estimated electric current value Iest in accordance with formula 2 described above, and calculates the target duty ratio Dutyref in accordance with formula 3 described above (step S108). As can be understood from formula 3, the estimated electric current value Iest is reflected in the target duty ratio Dutyref.

Next, the ECU 40 calculates the full stroke response time T_oland of the engagement pin 28 (step S110). The processing of this step S110 and the following step S112 correspond to the processing concerning the above-described determination E2 on continuation of the outer-periphery seating mode. In step S112 following step S110, the ECU 40 determines whether or not the full stroke response time T_oland calculated in step S110 is shorter than or equal to the required response time.

If the result of the determination of step S112 is positive, that is, if it can be judged that, even if the outer-periphery seating mode is continuously used while the coil current I is limited so as not to exceed the upper limit electric current value required in terms of the restriction on the temperature of the ECU 40, the engagement pin 28 can be protruded into the cam groove 26 within the required response time, the ECU 40 proceeds to step S114. In step S114, the ECU 40 changes the duty ratio from 100% used in the processing of step S106 to the target duty ratio Dutyref (i.e., the value according to the estimated electric current value Iest) calculated by the processing of step S108. As a result, the deep-groove seating mode is continuously used, and the engagement pin 28 is inserted into the inside of the cam groove 26 from the forward outer peripheral surface while the electric voltage according to the target duty ratio Dutyref is applied to the actuator 24.

If, on the other hand, the result of the determination of step S112 is negative, that is, if it can be judged that there is the possibility that, if the outer-periphery seating mode is continuously used while the coil current I is limited so as not to exceed the upper limit electric current value, the engagement pin 28 may not be protruded into the cam groove 26 within the required response time, the ECU 40 once turns OFF the energization of the actuator 24 (step S116). Next, the ECU 40 starts the energization of the actuator 24, at the energization start cam angle θcrnk, by the use of the target duty ratio Dutyref (i.e., the value according to the estimated electric current value Iest) calculated by the processing of step S108 (step S118). In this way, switching from the outer-periphery seating mode to the deep-groove seating mode is performed. That is, the two-time energization mode described above is performed.

4. Advantageous Effects of Energization Control of Actuator According to First Embodiment According to the processing of the routine shown in FIG. 14 described so far, if a predetermined exclusive condition based on each of the determinations of steps S100, S104 and S112 is not met (that is, if the results of the determinations of these steps are all positive), the following energization control is performed. To be more specific, in order to obtain the estimated electric current value Ist 1 (i.e., the estimation value of the electric current that flows through the actuator 24 (the coil 32) as a result of the energization being performed at the energization start cam angle θcrnk0), the outer-periphery seating mode is performed at a timing at which the energization start cam angle θcrnk arrives. Also, the greater the estimated electric current value Iest is, the lower the target duty ratio Dutyref becomes. The outer-periphery seating mode is performed while the electric voltage is controlled in accordance with the target duty ratio Dutyref determined in this way. As a result of this, the average electric voltage per unit time applied to the actuator 24 when the engagement pin 28 is protruded toward the cam groove 26 from the forward outer peripheral surface becomes lower when the estimated electric current value Iest is greater.

As already described, the lower the coil temperature is, the greater the coil current I becomes. Also, the coil current I also changes due to other factors, such as variation of the coil resistance value R. According to the processing of the routine described above, when the cam switching request is made, the execution of the energization for seating the engagement pin 28 on the forward outer peripheral surface is tried. Moreover, in a condition in which the outer-periphery seating is available, the estimated electric current value Iest (the estimated value Rst of the coil resistance) affected by the various electric current change factors, such as a change of the coil temperature, can be grasped by the use of the energization operation for the outer-periphery seating. On that basis, by more lowering, when the estimated electric current value Iest is greater, the average electric voltage per unit time applied to the actuator 24 when the engagement pin 28 is finally protruded toward the cam groove 26 from the forward outer peripheral surface, the coil current I obtained when engagement pin 28 is protruded in this way can be limited so as not to exceed the upper limit electric current value while also taking into consideration the effects of the various electric current change factors described above.

As described so far, according to the energization control of the actuator 24 of the present embodiment, the cam switching operation can be performed while preventing the coil current I from excessively increasing due to the various electric current change factors, such as a change of the coil temperature. Moreover, according to the countermeasures by this kind of energization control, an excessive increase of the coil current I can be reduced while grasping the effects of the change of the coil temperature without requiring an additional temperature sensor (that is, without an increase of cost).

(Advantageous Effects of Performing Determination E2 on Continuation of Outer-Periphery Seating Mode)

Moreover, the processing of the routine described above includes the determination E2 on continuation of the outer-periphery seating mode. This determination E2 is favorably combined with the above-described processing for limiting the coil current I in accordance with the estimated electric current value Iest. That is, according to the determination E2, if the full stroke response time T_oland of the engagement pin 28 is longer than the required response time (see FIG. 13) when the cam switching device 20 is caused to perform the cam switching operation by the use of the outer-periphery seating mode, the energization is once turned OFF after the engagement pin 28 is seated on the forward outer peripheral surface. Thus, the engagement pin 28 is retracted from the forward outer peripheral surface. On that basis, the energization of the actuator 24 is performed again such that the engagement pin 28 is protruded into the inside (the insert section) of the cam groove 26 at a combustion cycle that is the same as a combustion cycle in which the outer-periphery seating described above has been performed. In other words, the seating mode is switched from the outer-periphery seating mode to the deep-groove seating mode in which a shorter full stroke response time T_oland is obtained. According to this kind of processing, even if the protruding speed of the engagement pin 28 is low due to factors, such as the battery electric voltage V+B being low, by continuously using the deep-groove seating mode accompanied by the limitation of the coil current I based on the magnitude of the estimated electric current value Iest, the cam switching operation can be prevented from failing during a desired combustion cycle. In other words, even if the protruding speed of the engagement pin 28 is low as just described, the response speed of the actuator 24 can be ensured appropriately. In further addition to this, according to the above-described determination E2 on continuation of the outer-periphery seating mode, the worst value Y that corresponds to the operation guarantee minimum electric current value (see FIG. 6) is focused as a time required for the outer-periphery seating. That is, the determination E2 can be performed with taking into consideration the most severest condition concerning the protruding operation of the engagement pin 28 performed by the actuator 24. Therefore, the response speed of the actuator 24 can be ensured more surely.

Furthermore, the required response time used for the determination E2 is determined so as to be shorter when the engine speed Ne is higher. In this way, with taking the magnitude of the engine speed Ne obtained when the cam switching operation is performed, into consideration concerning the determination of the required response time, the determination E2 can be performed more precisely.

Other Embodiments (Example of Control of Driving Electric Voltage of Actuator Other than Duty Control)

In the first embodiment described above, in order to more lower, when the estimated electric current value Iest is greater, the average electric voltage per unit time applied to the actuator 24 when the engagement pin 28 is protruded toward the cam groove 26 from the forward outer peripheral surface, the target duty ratio Dutyref is more lowered when the estimated electric current value Iest is greater. Contrary to this kind of example, in an example of a control device configured such that the value itself of the electric voltage applied to the actuator can be changed, the average electric voltage described above may alternatively be more lowered by more lowering the value itself of the applied electric voltage when the estimated electric current value Iest is greater.

(Cam Switching Operation on Cylinder Group Basis)

In the first embodiment described above, the configuration including, in each cylinder, the cam carrier 22 on which the plurality of intake cams 14 and 16 and the cam groove 26 are formed and the actuator 24 associated with the cam carrier 22 has been taken as an example. In other words, the configuration in which the cam switching operation is performed for each cylinder has been taken as an example. However, this kind of cam carrier and actuator may alternatively be installed for each of cylinder groups that are composed of two or more cylinders. To be more specific, this kind of alternative cam switching device is required to be configured such that the cam carrier slides in the course of an engagement pin passing through a common base circle section of cams of a plurality of cylinders included in a cylinder group subject to the switching of cams.

(Example of Cam Switching Device of Performing Cam Switching Operation with Cam Groove without Sliding Operation of Cam)

The cam switching device 20 according to the embodiment described above includes the cam groove 26 that is provided on the outer peripheral surface of the camshaft 12 (more specifically, the outer peripheral surface of the cam carrier 22), and the actuator 24 which is equipped with the engagement pin 28 engageable with the cam groove 26 and which is capable of protruding the engagement pin 28 toward the camshaft 12. The cam switching device 20 is also configured such that, while the engagement pin 28 is engaged with the cam groove 26, the intake cams 14 and 16 that are fixed to the cam carrier 22 slide in association with the rotation of the camshaft 12 and that, as a result, the cam that drives the intake valve is switched. However, in the cam switching device intended for the present disclosure, the sliding of the cam itself is not always required, as far as the cam switching device includes the above-described forward outer peripheral surface on which the engagement pin can be seated, the engagement pin is inserted into the cam groove in response to the operation of the actuator and, as a result, the cam that drives the valve is switched. Thus, the cam switching device may alternatively be configured, as disclosed in WO 2011064852 A1, for example, so as to be accompanied by the sliding operation of the cam even though the cam groove provided on the outer periphery surface of the camshaft is used. To be more specific, the cam groove intended for the present disclosure may not be always formed on the outer peripheral surface of a cam carrier (that serves as a part of the outer peripheral surface of a camshaft) that is separated from the camshaft as with the cam groove 26 of the variable valve operating device 10, and may alternatively be formed on the outer peripheral surface of the cylindrical part (that serves as a part of the outer peripheral surface of the camshaft) that is formed (fixed) at a part of the camshaft as with the cam groove of the cam switching device disclosed in WO 2011064852 A1. Moreover, the engagement pin intended for the present disclosure may not always be built in the actuator as with the engagement pin 28 of the cam switching device 20. That is, the engagement pin may alternatively be, for example, a projection part of a sliding member (sliding pin) arranged between a lock pin (which is not an "engagement pin" engaged with the cam groove) that is built in an electromagnetic solenoid type actuator and the cam groove in the cam switching device disclosed in WO 2011064852 A1. Furthermore, the number of the engagement pins provided for each cylinder or each cylinder group may not always be plural as with the engagement pin 28 of the variable valve operating device 10, and may be one as with the cam switching device disclosed in WO 2011064852 A1.

The embodiments and modifications described above may be combined in other ways than those explicitly described above as required and may be modified in various ways without departing from the scope of the present disclosure.

What is claimed is:

1. A control device for an internal combustion engine, the internal combustion engine including:

a camshaft which is driven to rotate;

a plurality of cams which are provided at the camshaft and whose profiles are different from each other; and a cam switching device configured to perform a cam switching operation that switches, between the plurality of cams, a cam that drives a valve that opens and closes a combustion chamber, wherein the cam switching device includes:

a cam groove which is provided on an outer peripheral surface of the camshaft; and an electromagnetic solenoid actuator which is equipped with an engagement pin engageable with the cam groove, and which is capable of protruding the engagement pin toward the camshaft, wherein the cam switching device is configured such that, while the engagement pin is engaged with the cam groove, the cam that drives the valve is switched between the plurality of cams in association with a rotation of the camshaft, wherein the outer peripheral surface of the camshaft includes a forward outer peripheral surface which is located more forward than an end of the cam groove on a forward side in a rotational direction of the camshaft, and wherein the control device is configured, in causing the cam switching device to perform the cam switching operation, to perform first energization of the actuator such that the engagement pin is seated on the forward outer peripheral surface of the camshaft, and to perform second energization following the first energization such that, when an electric current flowing through the actuator as a result of the first energization being performed increases, an average electric voltage per unit time applied to the actuator in protruding the engagement pin toward the cam groove from the forward outer peripheral surface of the camshaft decreases.

2. The control device according to claim 1, wherein the control device is configured, if a time required from a start of a protruding operation of the engagement pin toward an inside of the cam groove until a completion thereof is longer than a certain time in causing the cam switching device to perform the cam switching operation with the energization for seating the engagement pin on the forward outer peripheral surface, to retract the engagement pin from the forward outer peripheral surface after the engagement pin is seated on the forward outer peripheral surface, and to perform energization of the actuator such that the engagement pin is protruded in the cam groove during a combustion cycle that is the same as a combustion cycle in which the engagement pin has been seated on the forward outer peripheral surface.

3. The control device according to claim 2, wherein the certain time is shorter when an engine speed is higher.

* * * * *